United States Patent [19]

Eddlemon et al.

[11] 4,004,619

[45] Jan. 25, 1977

[54] METHOD AND APPARATUS FOR PREPARING AND PACKAGING MASTIC COATING MATERIAL

[75] Inventors: Cecil A. Eddlemon, Gretna; Robert J. Harris, Marrero; George E. Hanson, Belle Chasse, all of La.

[73] Assignee: H. C. Price Co., Bartlesville, Okla.

[22] Filed: Apr. 28, 1976

[21] Appl. No.: 681,021

[52] U.S. Cl. ..... 141/11; 53/25; 53/127; 141/82; 141/186; 141/237; 222/146 H

[51] Int. Cl.[2] ..... B65B 63/08

[58] Field of Search ..... 141/11, 82, 186, 237; 53/25, 127; 222/146 H

[56] References Cited

UNITED STATES PATENTS

| | | | |
|---|---|---|---|
| 2,127,402 | 8/1938 | Gillican | 53/25 X |
| 3,837,778 | 9/1974 | Parker | 53/127 X |

*Primary Examiner*—Travis S. McGehee
*Attorney, Agent, or Firm*—Lowe, Kokjer, Kircher, Wharton & Bowman

[57] ABSTRACT

A method and apparatus for packaging thermoplastic fluid material is the subject of the present invention. The thermoplastic material is mixed at an elevated temperature and emptied in predetermined batch quantities into a holding area. A gate in the bottom of the holding area is operable to empty the batch of material in a very short time span. A plurality of heating elements are disposed beneath the outlet of the holding means and are maintained at a temperature high enough to cause parting of the fluid material as it passes over the heating elements. Thus the batch of material from the holding area will be divided into a plurality of individual masses as the material passes over the heating elements. By utilizing a number of heating elements equal to one less than the number of containers to be filled, and by spacing the heating elements equi-distances apart, the individual masses of material will be equal in size and the number of individual masses will equal the number of containers. The containers are positioned immediately beneath the heating elements to receive the material and are filled simultaneously.

16 Claims, 4 Drawing Figures

SAND
20
LIME
18
24
ASPHALT STORAGE
22
2.
26
HOT OIL RESERVOIR AND HEATER
93
16
ASPHALT HOLDING TANK AND HEATER
28
94
96
54
30
56
48
10
52
98
96
62
102
106
104
84
108
76
74
82
100
72
108
2.

METHOD AND APPARATUS FOR PREPARING AND PACKAGING MASTIC COATING MATERIAL

BACKGROUND AND SUMMARY OF THE INVENTION

This invention relates to the packaging of thermoplastic materials and, more particularly, to a method and apparatus for packaging a thermoplastic fluid material in a plurality of individual containers.

Protective corrosion coatings for pipe sometimes take the form of asphalt base material which is extruded onto the pipe in a coating yard. It is of course necessary to leave an uncoated area at each end of the pipe so that the individual lengths of pipe may be welded together. After the individual lengths or joints of pipe have been welded, the uncoated end portions of the two welded joints are then coated with a protective asphalt base coating. The asphalt base coating normally comprises a mixture of asphalt, sand and lime.

The joint coating material has heretofore been supplied to pipeline contractors and lay barge operators in the form of dry ingredients and asphalt which are mixed together at the job site and then applied as a protective coating to the pipe. This requires a certain amount of skill on the part of the laborer who must accurately mix the ingredients in order to obtain the desired coating. Time also becomes a factor in mixing the ingredients as a definite period of time is required to obtain the necessary homogeneity between the dry ingredients and the asphalt base.

Because of the foregoing disadvantages of mixing the pipe coating material at the job site, an attempt has been made to provide the joint coating material in premixed form. This allows the contractor or barge operator to simply melt the material at the job site and not have to worry with proper mixing of the component ingredients. A time saving is also effected because the material is premixed. A problem which has been encountered in supplying premixed material is to make it available in quantities which can be easily handled without large mechanical equipment. Thus, while a relatively small quantity is desirable from a handling standpoint, this increases the problems of packaging the material on a high production basis. If the material is packaged in individual containers and only a single container filled at a time, production is slowed to a point where the economics become impractical.

It is, therefore, an object of the present invention to provide a method and apparatus for packaging asphaltic pipe coating material in individual containers in a manner which will be economically feasible.

Another objective of the present invention is to provide a method and apparatus for packaging the thermoplastic fluid material in a plurality of individual containers.

An important aim of this invention is to provide a method and apparatus for packaging a thermoplastic fluid material in a plurality of individual containers simultaneously.

As a corollary to each of the above aims and objects, an important objective of the invention is to provide a method and apparatus as stated wherein waste of material as the individual containers are filled is minimized.

Another corollary to the aims and objects set forth above is to provide a method and apparatus as stated wherein clean up of equipment is minimized by providing for a substantial filling of the individual containers with all of the material available at any one time and without overfilling of the containers.

Still another objective of this invention is to provide a method and apparatus for packaging thermoplastic fluid material in a plurality of individual containers wherein the containers are filled simultaneously and moved along a conveyor line as additional containers are moved into position to receive the fluid material.

Other objects of the invention will be made clear or become apparent from the following description and claims when read in light of the accompanying drawings wherein:

Figure 1:
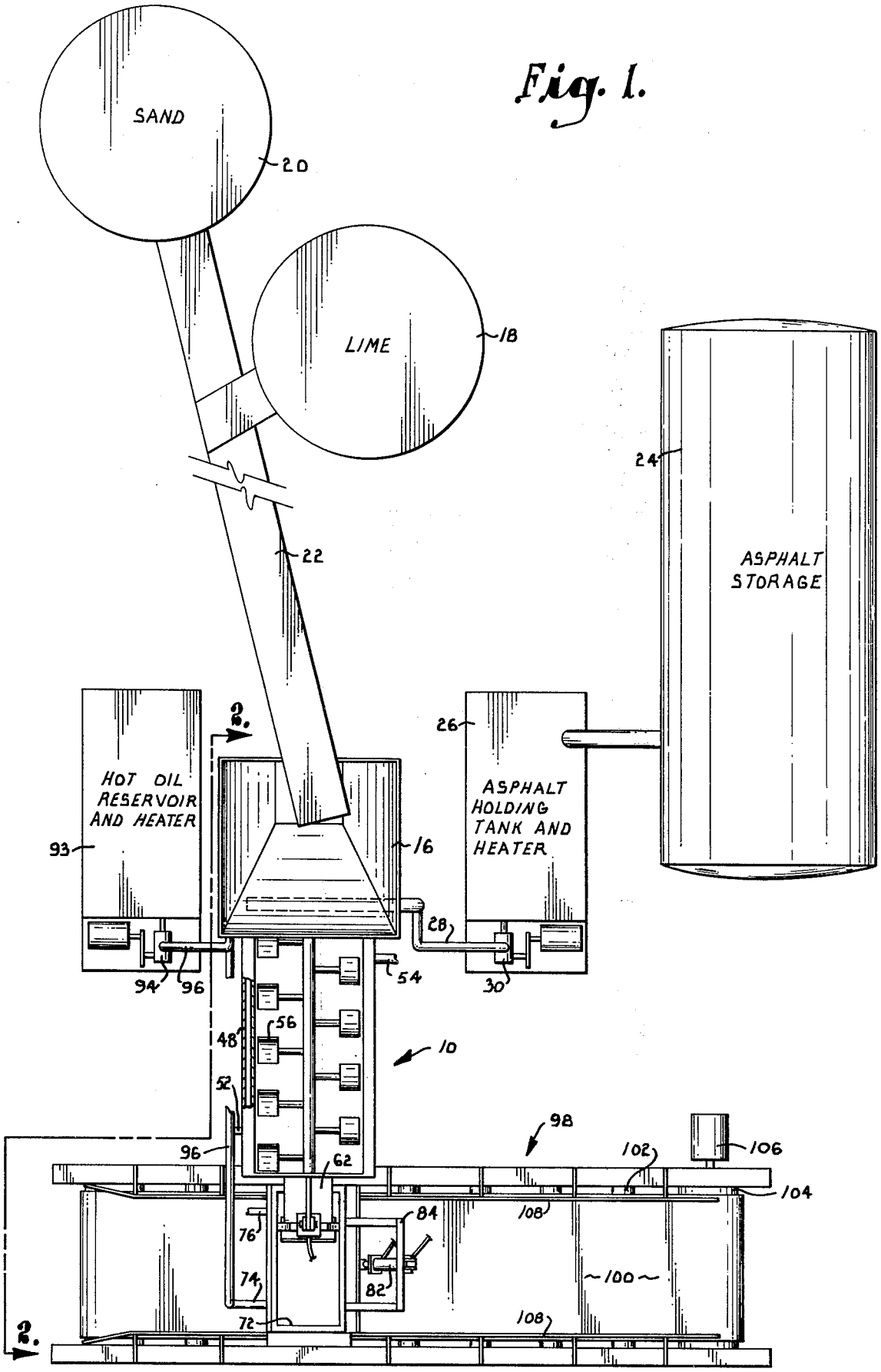
FIG. 1 is a top plan view of a plant for carrying out the method of the present invention and incorporating the apparatus of the invention.

Referring initially to FIG. 1 of the drawings, the thermoplastic fluid coating material is mixed in a pug mill 10.

Dry ingredients consisting of sand and lime are fed into pug mill 10 from a hopper 16 which receives lime from a storage tank 18 and sand from a storage tank 20 both via a conveyor system 22.

Asphalt is delivered to the pug mill 10 from a storage area 24 via a holding tank 26 wherein the asphalt is heated to a temperature of between 300° F. and 350° F. The material is passed from the tank 26 to pug mill 10 through a delivery conduit 28 by a pump 30.

Figure 2:
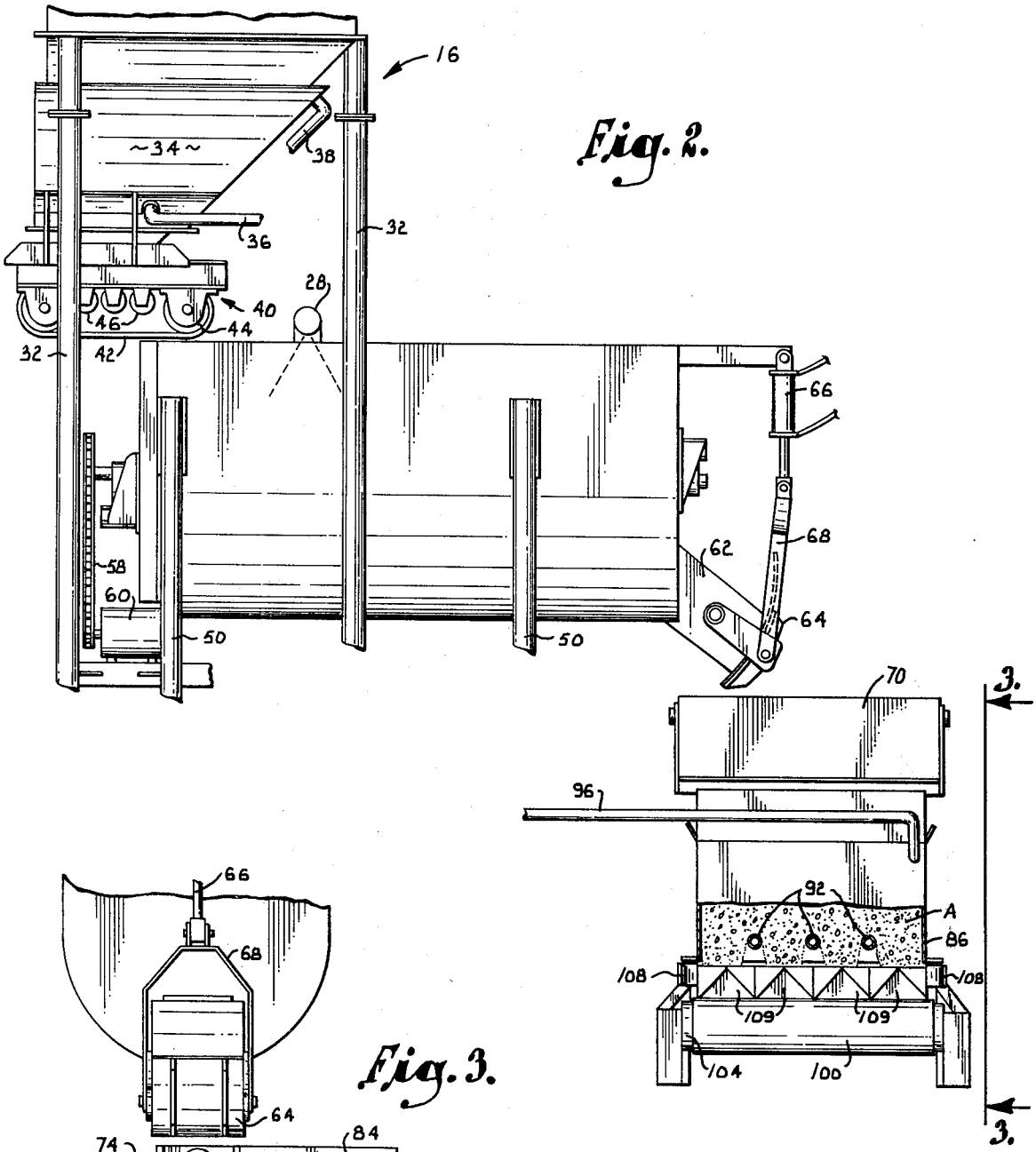
FIG. 2 is a horizontal sectional view of the plant in FIG. 1 taken along line 2—2 of FIG. 1.

Details of construction of hopper 16 are best illustrated in FIG. 2. The hopper is mounted in an elevated position by a plurality of upright standards 32 and the lower portion of the hopper bin is provided with a fluid-tight jacket 34 at the bottom of the hopper so as to provide a double-walled construction for circulation of a heated fluid. To this end, an inlet pipe 36 and an outlet pipe 38 direct the heated fluid to and from the jacket.

At the bottom of hopper 16 there is mounted a conveyor assembly 40 comprising a belt 42 and supporting rollers 44 and 46.

Turning now to details of construction of pug mill 10, with reference to both FIGS. 1 and 2, a tank 48 is supported by a plurality of legs 50 and is of double-walled construction so as to provide an area for circulating the heated fluid. To this end, an inlet conduit 52 and an outlet conduit 54 direct the heated fluid to and from the tank 48.

Rotatably mounted inside of tank 48 is a paddle agitator 56 best illustrated in FIG. 1. Agitator 56 is rotated by a drive chain 58 and a motor 60 (FIG. 2).

A down spout 62 which communicates with the interior of tank 48 provides an outlet from the tank. A pivotal gate member 64 closes the outlet opening and may be moved reciprocably by a cylinder 66 which is coupled with the gate through a yoke assembly 68 (see FIG. 3).

A batch holding tank 70 has an open top 72 for receiving material from spout 62. Tank 70 is also of double-walled construction and has an inlet conduit 74 and an outlet conduit 76 coupled therewith for directing heated fluid into the chamber provided by the double-walled construction.

Figure 3:
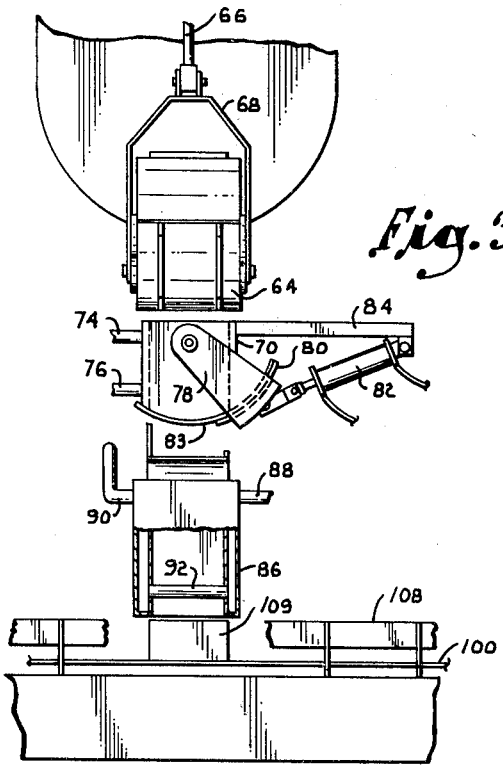
FIG. 3 is a vertical elevational view looking in the direction of arrows 3—3 of FIG. 2.

Pivotally mounted depending arms 78, one of which is visible in FIG. 3, mount a concave gate 80 which is complemental in configuration to the convex bottom 83 of tank 70. Gate 80 is movable through an arcuate path by means of a cylinder 82 which is supported by a laterally extending framework 84.

Disposed in spaced relationship to the bottom of batch holding tank 70 is a double-walled confining skirt 86 which is open on two sides and closed on its other sides. The construction again allows for coupling of an inlet conduit 88 and an outlet conduit 90 for directing heated fluid to and from the compartment presented by the double-walled construction. Disposed in closely spaced relationship to the bottom of skirt 86 are a plurality of conduits 92 which communicate with the compartment presented by the double-walled construction. Manifestly, when heated fluid is passed through conduits 92, the latter serve as heating elements which cause parting of any material passing through skirt 86.

Hot oil is passed through jacket 34 of hopper 16, the double-walled compartment of tank 48, the compartment presented by double-walled tank 70, and skirt 86 from a reservoir tank 93 provided with a pump 94 which directs fluid through a trunk line 96.

A conveyor 98 is disposed in a generally horizontal plane and extends beneath the bottom opening of skirt 86. Conveyor 98 comprises a belt 100, supporting rollers 102 and 104 and a drive motor 106. Bumpers 108 are disposed in parallel relationship on either side of conveyor belt 100.

In operation, the heated asphalt, sand and lime are mixed together in pug mill 10 to achieve the desired homogeneous mixture. The asphalt from holding tank 26 is heated to a temperature of about 300° to 350° F. and hot oil from reservoir tank 93 is maintained at a temperature of about 350° to 400° F. Thus, the oil temperature in any one of the jackets for hopper 16, pug mill 10, holding tank 70 and skirt 86 will be within the range of 300° to 350° F. As the material is being mixed in pug mill 10, a plurality of containers 109 are placed on conveyor belt 100 in contiguous side-by-side relationship. It is important that the size of the containers be selected so that when a plurality of the containers are positioned on the conveyor belt, conduits 92 for the hot oil will lie in a vertical plane which extends upwardly between each adjacent pair of containers. It is also desirable for the outside diameter of conduits 92 to be at least equal to the combined thickness of the two contiguous walls of containers 109. In some instances, it may be desirable to place containers 109 on a pallet for ease in handling and storage after the containers are filled.

Figure 4:
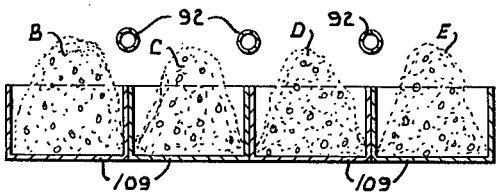
FIG. 4 is an enlarged fragmentary detail view of the fluid material as it enters the individual containers simultaneously.

The fluid asphalt material is passed out of pug mill 10 by opening gate 64 for a period of time so as to allow a batch quantity of the material to substantially fill holding tank 70. This batch quantity of material which is introduced into the holding area presented by tank 70 is designated by the reference letter A in FIG. 2 and is approximately equal to the combined capacity of the four containers 109 which are positioned beneath skirt 86. When the containers are in position beneath holding tank 70, cylinder 82 is actuated to move gate 80 to its open position to allow the batch of material A to gravitate through confining skirt 86. As the batch of material A passes over heated conduits 92, the material is divided into a plurality of individual masses designated by the reference letters B through E in FIG. 4. Because the spacing of conduits 92 is equidistant apart, the quantity of material A is divided into individual masses substantially equal in size and corresponding to the capacity of the individual containers 109.

It is, of course, important that the temperature of the heating conduits or other type of heating elements which may be employed, be high enough so as to effect parting of the fluidized mass of material into the individual masses. Generally, if the temperature within the conduits is at least 25° F. above the melting point of the mass of material, parting will occur. It is also desirable for tank 70 to be constructed with an outlet opening of a size to accommodate substantially complete emptying of the contents in no more than about 3 seconds.

Having thus described the invention, we claim:

1. A method of simultaneously packaging a fluid, thermoplastic material in a plurality of containers when the material is initially present in bulk in a holding area, said method comprising the steps of:

positioning a plurality of said containers in side-by-side relationship beneath said holding area;

interposing a heating element in a vertical plane which extends upwardly between each adjacent pair of containers, each of said heating elements also lying in a horizontal plane which is intermediate said holding area and the uppermost edges of said containers; and passing the bulk material out of the holding area so said material can follow a path toward said containers, said material passing over said heating element as it travels said path thereby dividing itself into a plurality of individual masses equal to the number of containers and then passing into said containers.

2. A method as set forth in claim 1, wherein the quantity of material in said holding area at any one time is no greater than the combined capacity of said containers.

3. A method as set forth in claim 2, wherein the quantity of material in said holding area at any one time is less than the combined capacity of said containers.

4. A method as set forth in claim 1, wherein is included the step of maintaining the temperature of said heating element above the temperature of the material in said holding area.

5. A method as set forth in claim 1, wherein said material is characterized by being solid at ambient temperatures and said heating element is maintained at least 25° F. above the melting temperature of said material.

6. A method as set forth in claim 1, wherein said positioning step comprises positioning said containers in contiguous relationship and restraining said containers against lateral movement away from said contiguous relationship.

7. A method as set forth in claim 6, wherein said interposing step comprises interposing said heating element in closely spaced relationship to the uppermost edges of said containers.

8. A method as set forth in claim 1, wherein said material comprises an asphalt base substance having a melting point of about 250° F., and wherein is included the step of maintaining said heating elements at a temperature of about 350° F.

9. Apparatus for simultaneously packaging a fluid thermoplastic material in a plurality of containers, said apparatus comprising:

means for holding said material in a fluid state;

means for releasing from said holding means a quantity of material no greater than the combined capacity of said containers; and heating element means for causing said quantity of material to divide into a plurality of individual masses of approximately equal size whereby when said containers are positioned beneath said heating element means said containers are simultaneously filled.

10. Apparatus as set forth in claim 9, wherein the quantity of material in said holding means is no greater than the combined capacity of said containers and said releasing means is operable to empty said holding means in a short interval of time.

11. Apparatus as set forth in claim 9, wherein is included confining means extending from said holding means to at least about the level of said heating element to retain said material within a predefined path of travel.

12. Apparatus as set forth in claim 11, wherein said releasing means is operable to empty said holding means in no more than about three seconds.

13. Apparatus as set forth in claim 11, wherein is included means for advancing a plurality of said containers to a point for receiving said individual masses of material.

14. Apparatus as set forth in claim 13, wherein said material comprises an asphaltic base composition and wherein said heating element comprises a conduit for hot oil.

15. Apparatus as set forth in claim 14, wherein said holding means comprises an open top holding chamber extending over a length approximately equal to the combined dimension of said plurality of containers when the latter are disposed in side-by-side contiguous relationship, the other dimension of said chamber being approximately equal to the corresponding dimension of one of said containers.

16. Apparatus as set forth in claim 15, wherein is included means for holding said containers in said side-by-side contiguous relationship as the containers are advanced to said receiving point.

* * * * *